United States Patent [19]

Adams

[11] Patent Number: 4,541,778

[45] Date of Patent: Sep. 17, 1985

[54] PIN ROOTED BLADE BIAXIAL AIR SEAL

[75] Inventor: James D. Adams, Palm Beach Gardens, Fla.

[73] Assignee: The United States of America as represented by the Secretary of the Navy, Washington, D.C.

[21] Appl. No.: 611,652

[22] Filed: May 18, 1984

[51] Int. Cl.[4] ..... F01D 5/22; F01D 5/30

[52] U.S. Cl. ..... 416/193 A; 416/134 R; 416/222

[58] Field of Search ..... 416/193 A, 193 R, 222, 416/134 R

[56] References Cited

U.S. PATENT DOCUMENTS

| | | | |
|---|---|---|---|
| 2,595,829 | 5/1952 | Dean | 416/134 R X |
| 2,919,889 | 1/1960 | Rubel | 416/193 A X |
| 2,936,155 | 5/1960 | Howell et al. | 416/134 R |
| 2,944,787 | 7/1960 | Gingras | 416/193 A X |
| 2,955,799 | 10/1960 | Oickle | 416/193 A X |
| 3,042,369 | 7/1962 | Welsh | 416/222 X |
| 3,656,864 | 4/1972 | Wagle | 416/193 A X |
| 3,972,645 | 8/1976 | Kasprow | 416/193 A X |
| 4,175,912 | 11/1979 | Crane et al. | 416/193 A |

FOREIGN PATENT DOCUMENTS

| | | | |
|---|---|---|---|
| 621315 | 4/1949 | United Kingdom | 416/222 |
| 667979 | 3/1952 | United Kingdom | 416/193 A |
| 1394739 | 5/1975 | United Kingdom | 416/193 A |
| 1457417 | 12/1976 | United Kingdom | 416/193 A |
| 200107 | 10/1967 | U.S.S.R. | 416/193 A |

*Primary Examiner*—Everette A. Powell, Jr.

*Attorney, Agent, or Firm*—Robert F. Beers; Robert W. Adams

[57] ABSTRACT

In an axial flow compressor rotor stage having a blade mount rail about the periphery thereof, a seal is positioned below the blade platforms to provide improved compressor gas path efficiency. Each blade platform has a seal bonded to the underside thereof, said seals extending toward adjacent blade platforms and providing sealing means in the interstices between said platforms as well as between said platforms and said blade mount rail.

1 Claim, 3 Drawing Figures

PIN ROOTED BLADE BIAXIAL AIR SEAL

BACKGROUND OF THE INVENTION

This invention relates primarily to the field of gas turbine engines. More particularly the invention relates to pin rooted compressor blades utilized in such engines, and in even greater particularity the invention may be described as a unitary construction seal for total sealing of a blade/mount rail attachment.

Improvements to compressor performance depend in some cases on reducing air recirculation at any point in the compressor where such occurs. One place where compressor gas path efficiency can be improved is in the area of adjacent blade platforms on the periphery of the rotor, since the blade platforms must be spaced closely together. Seals for these clearance spaces are difficult to position in such a manner as to be effective without being expensive. The best type of seal is one requiring a minimum of parts and a minimum number of assembly problems.

SUMMARY OF THE INVENTION

According to the present invention, an elastomeric seal is captured between the blade root and the blade mount rail, said elastomeric seal extending along said blade mount rail to form a complete seal between blade platforms by cooperation with an elastomeric seal captured by an adjacent blade. Each seal is bonded to the lower surface of each blade platform and is compressed between the platform and the blade mount rail to provide sealing not only between platforms but also between platforms and said blade mount rail.

It is an object of the present invention to provide total sealing for the blade/mount rail attachment with a fixed one piece reusable seal.

Yet another object of the invention is to provide a platform sealing beam which will facilitate ease of manufacture and placement of said seals.

The foregoing and other objects, features, and advantages of the present invention will become more apparent in the light of the following detailed description of the preferred embodiment thereof as illustrated in the accompanying drawings.

DESCRIPTION OF THE PREFERRED EMBODIMENT

Figure 1:
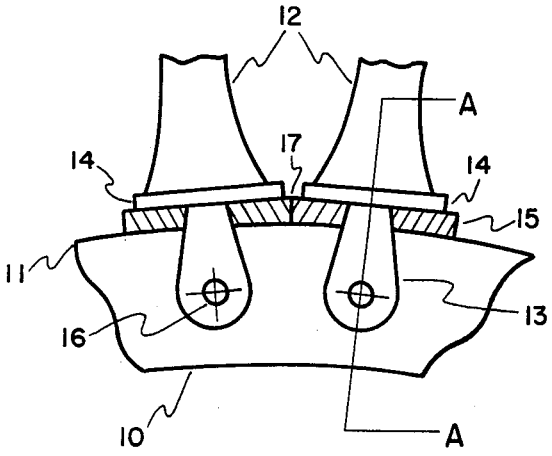
FIG. 1 is a view of a section of the periphery of the rotor along the axis showing the blades and their attachment thereto.
Figure 2:
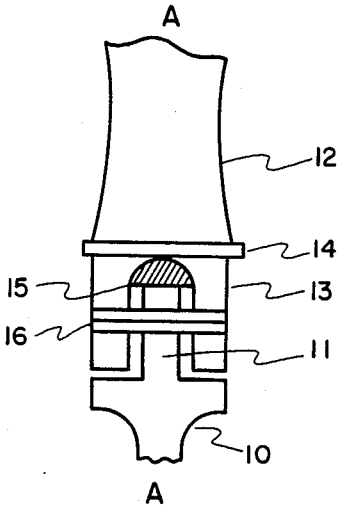
FIG. 2 is a section along line AA of FIG. 1.

As shown in FIGS. 1 and 2, the compressor rotor 10 has a circumferential blade mount rail 11 along its periphery. Blades 12 are attached to rail 11 by means of slotted roots 13 configured so as to receive rail 11 within slots thereof and being connected to rail 11 by fasteners 16. Each blade 12 carried by the associated root 13 has a platform 14 overlying the periphery of the rotor, the operative portion of the blade extending radially outward from the platform.

Adjacent platforms 14 are slightly spaced apart circumferentially for the purpose of assembly, thermal expansion, and efficient operation, leaving a narrow slot 17 as shown in FIG. 1. Unless this slot is closed during compressor operation, the compressor operation and efficiency may be detrimentally affected. Additionally, as shown in FIG. 2, there remains a space between rails 11 and platform 14 when blade 12 is mounted onto rail 11. This space must also be sealed to improve the compressor gas path efficiency.

Figure 3:
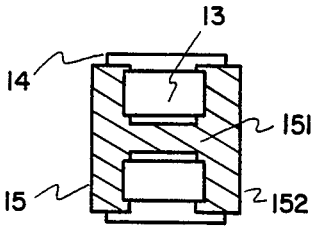
FIG. 3 is a bottom view of a blade with a seal.

To accomplish this a seal 15, as shown in all three Figures, is utilized. Seal 15 is an elastomeric rubber H-shaped seal which is bonded to the blade platform 14 as shown in FIG. 3. Seal 15 is slightly thicker than the separation between the periphery of mount rail 11 and the bottom of platform 14, thus sealing is provided in two ways; (1) axial sealing is provided by the compression of seal 15 between platform 14 and mount rail 11, and (2) the interface of adjacent seals in the assembly provides sealing radially between blade platforms 14, i.e., space 17 is thereby sealed. FIGS. 1 and 2 clearly illustrate the sealing actions of seals 15 along the periphery of mount rail 11. The H-shape configuration of elastomeric seal 15 is provided by two parallel sections 152 and a crossbar 151 intermediate said parallel sections and perpendicular thereto. Crossbar 151 extends through said slotted root 13 and is aligned along the periphery of mount rail 11. Crossbar 151 is approximately the same width as mount rail 11. Parallel sections 152 are aligned parallel to the axis of rotor 10. The width of parallel sections 152 is such that the sum of the width of said parallel sections 152 and the length of crossbar 151 is equal to the separation of adjacent blades 12 at the center thereof as measured along the periphery of mount rail 11. It will be noted that seal 15 is affixed to the bottom of platform 14 and does not require any centrifugal loading to be urged into place as a sealant either between platform 14 and mount rail 11 or in the interstice 17 between platforms. The seal can be molded or stamped from sheet stock depending on the dimensional requirements for the particular rotor and blades in which it is to be utilized.

Although the invention has been shown and described with respect to a preferred embodiment thereof, it should be understood by those skilled in the art that other various changes and omissions in the form and detail thereof may be made therein without departing from the spirit and the scope of the appended claims.

What is claimed is:

1. A rotor assembly comprising a rotor having a circumferential blade mount rail; a plurality of blades circumferentially spaced around the outer rim of said rotor leaving a slot between adjacent blades for the assembly, thermal expansion and efficient operation of said rotor assembly, each blade having a platform from which a pair of parallel, slotted roots circumferentially dimensioned less than said platform extend radially inward to straddle said rail and are secured thereto by a fastener that passes through said roots and said rail, wherein said roots join near said platform in an arcuate curve radially spaced from the perimeter of said rail; and an elastometric seal bonded to the radially inner surface of said platform and having first and second parallel sections in axial alignment with said rotor and joined by a third, crossbar, section perpendicular to said parallel sections and in radial contact with said rail, wherein the radial dimension of said seal is slightly greater than the separation of said platform from said rail so as to cause said seal to be compressed when said blade is secured to said rotor, the axial dimension of said crossbar section being approximately equal to the axial dimension of said rail and the combined circumferential dimensions of said crossbar section, and said first and second parallel sections being equal to said circumferential spacing between said blades, such that the length of said rail under each said blade is sealed to said blade by said crossbar section in cooperation with said parallel sections, and the slot between said circumferentially spaced blades is sealed by the abutting parallel sections of adjacent blades.

* * * * *